US010753690B2

(12) United States Patent
Mooradian et al.

(10) Patent No.: US 10,753,690 B2
(45) Date of Patent: Aug. 25, 2020

(54) CLEANING APPARATUS FOR COOLING TUBE ARRAY

(71) Applicant: Johannes Stickling, Philadelphia, PA (US)

(72) Inventors: Matthew Mooradian, Nassau, NY (US); Johannes Stickling, Philadelphia, PA (US)

(73) Assignee: Johannes Stickling, Philadelphia, PA (US)

( * ) Notice: Subject to any disclaimer, the term of this patent is extended or adjusted under 35 U.S.C. 154(b) by 405 days.

(21) Appl. No.: 15/719,839

(22) Filed: Sep. 29, 2017

(65) Prior Publication Data

US 2019/0101343 A1 Apr. 4, 2019

(51) Int. Cl.

| | |
|---|---|
| ***F28G 1/16*** | (2006.01) |
| ***F28G 15/04*** | (2006.01) |
| ***B08B 3/02*** | (2006.01) |
| ***F22B 37/48*** | (2006.01) |
| ***F28B 1/06*** | (2006.01) |
| ***B08B 9/023*** | (2006.01) |
| ***F28G 15/02*** | (2006.01) |

(52) U.S. Cl.

CPC ..... *F28G 1/166* (2013.01); *B08B 3/024* (2013.01); *B08B 9/023* (2013.01); *F22B 37/48* (2013.01); *F28B 1/06* (2013.01); *F28G 15/02* (2013.01); *F28G 15/04* (2013.01)

(58) Field of Classification Search

None

See application file for complete search history.

(56) References Cited

U.S. PATENT DOCUMENTS 3,843,409 A 10/1974 Ice, Jr.
3,903,912 A * 9/1975 Ice, Jr. ..... B08B 9/0323 134/167 C
3,938,535 A * 2/1976 Cradeur ..... F28G 15/04 134/167 C (Continued)

FOREIGN PATENT DOCUMENTS

DE 102009052676 A1 * 11/2009
DE 2010010011 A1 * 3/2010

(Continued)

OTHER PUBLICATIONS

English machine translation of WO2013/178353A1.*

*Primary Examiner* — Michael E Barr
*Assistant Examiner* — Jason P Riggleman
(74) *Attorney, Agent, or Firm* — Richard M. Goldberg

(57) ABSTRACT

A cleaning apparatus for cleaning a cooling tube array (15) of a heat exchanger has a nozzle carriage (16) movably held on a truss beam, and a plurality of cleaning nozzles (40) mounted to the nozzle carriage. A truss beam has two parallel C-channel rails (20) having back sides that face each other, a tube (22) arranged separate and distant from the C-channel rails and at a different height than the C-channel rails in a cross-sectional plane of the truss beam, and truss supports (24) connecting the rails and the tube; the nozzle carriage has rollers (48) that are arranged for travelling in the C-channel rails. A water intake (82) is coupled to the nozzle manifold (42) and to a hydraulic drive (80) having a mechanical power take-off member (96) that is operably coupled to the nozzle carriage (16) for moving the nozzle carriage.

20 Claims, 8 Drawing Sheets

(56) References Cited

U.S. PATENT DOCUMENTS

| | | | |
|---|---|---|---|
| 5,735,964 | A | 4/1998 | Amuny |
| 9,605,916 | B2 | 3/2017 | Stickling et al. |
| 2016/0084595 | A1 | 3/2016 | Stickling et al. |

FOREIGN PATENT DOCUMENTS

| | | | |
|---|---|---|---|
| DE | 102009052676 | A1 | 5/2011 |
| DE | 102010010011 | A1 | 5/2011 |
| DE | 202010017403 | U1 | 1/2012 |
| DE | 102012021177 | A1 | 12/2013 |
| DE | 102012021178 | A1 | 12/2013 |
| EP | 1604164 | B1 | 12/2005 |
| EP | 2317273 | A2 | 5/2011 |
| EP | 2317274 | A2 | 5/2011 |
| FR | 2389090 | A1 | 11/1978 |
| FR | 2955651 | A1 | 7/2011 |
| GB | 458092 | A | 12/1936 |
| WO | 2013/178353 | A2 | 12/2013 |
| WO | WO2013/178353 | A1 * | 12/2013 |

* cited by examiner

CLEANING APPARATUS FOR COOLING TUBE ARRAY

FIELD OF THE INVENTION

The invention relates to a cleaning apparatus for a cooling tube array of a heat exchanger or condenser, in particular an air cooled condenser of, for example, a power station or a chemical plant.

BACKGROUND OF THE INVENTION

In a typical air cooled condenser of a fuel, coal or gas-fired power station, steam flows into cooling tube arrays or bundles, which are cooled by a forced air flow. The arrays, which each form a generally flat, rectangular field, may be arranged at an angle in the range of 0 to 90 degrees with respect to the horizontal plane. For example, two arrays may be erected to form an A-shaped structure. The cooling tubes are fin tubes, i.e. tubes having cooling fins integrally mounted or formed thereon. The steam enters the cooling tubes in parallel flow from the top. Fans that are arranged below the structure draw ambient air and discharge it along the cooling tubes for cooling. The air crosses the tube arrays from below.

Because of the outdoor installation, and because the fans draw ambient air, dirt gradually accumulates on the cooling tube arrays. Resulting cooling performance deficits may involve performance deficits of the power station, so that cleaning is required. However, cleaning large cooling tube arrays manually using high-pressure cleaners is dangerous and hard labor. For example, ambient temperatures at the working area may even reach e.g. 60° C. to 70° C. A cooling tube array may have a height along the inclined direction of the tubes of e.g. 10 meters, and may extend over a length of e.g. 80 meters in the lateral direction. The inclination angle may, in particular, be 60° or more with respect to the horizontal.

U.S. Pat. No. 9,605,916 B2 describes a cleaning apparatus for cleaning a cooling tube array of a heat exchanger, including a triangular truss beam supported to be movable in a first direction, which direction is perpendicular to a longitudinal direction of the truss beam, a nozzle carriage movably held on the truss beam, the nozzle carriage being movable along the longitudinal direction of the truss beam, and a plurality of cleaning nozzles mounted to the nozzle carriage, the truss beam having two tubular top chords and one tubular bottom chord that is arranged centrally below the top chords, and bracings that connect the chords, and the nozzle carriage having at least one bottom chord roller that is arranged for traveling on the bottom side of the bottom chord; and a similar cleaning apparatus having a square truss beam. In an example, a motor that drives a pulley is mounted to the truss beam.

WO 2013/178353 A2 describes a cleaning apparatus for spraying cooling coils with water. The apparatus has travelling profiles that can be displaced over the cooling coils, and a carrying system for nozzles can be displaced along the travelling profiles. In one example, there are two C-shaped travelling profiles that are arranged with the opening facing upwards. A nozzle-carrying system engages the C-shaped profiles with arms and guide pieces. In another example, the travelling profiles are C-profiles or U-profiles, the openings of the profiles face each other, and the nozzle-carrying system has rollers engaging the profiles. The nozzle-carrying system is positioned between the profiles and is moved by a belt drive.

DE 10 2012 021 177 A1 and DE 10 2012 021 178 A1 describe cleaning devices having a travelling profile in the form of a truss beam. The truss beam has chord tubes and bracings connecting the chord tubes. A nozzle-carrying system is carried on the truss beam by pairs of rollers that travel on the chord tubes.

EP 1604164 B1 and DE 10 2009 052 676 A1 describe a mobile cleaning device for air cooled condensation units, in which a cleaning nozzle carrier is displaceable suspended from a square profile that is arranged such that a diagonal of the square is vertical. The carrier comprises rollers that travel on the flat sides of the square profile.

EP 2 317 274 A2 and DE 20 2010 017 403 U1 describe cleaning devices for a heat exchanger, with a ladder consisting of side walls and ladder rungs, to which two parallel arranged profiles are fastened, in or on which a nozzle holder is movable. In an example, the profiles are U-profiles that are arranged with their openings facing each other. The nozzle holder engages the U-profiles with rollers and hold the nozzle holder centrally between the U-profiles.

EP 2 317 273 A2 and DE 10 2010 010 011 A1 describe cleaning devices having a rectangular pipe profile, on which a nozzle holder is movably held by rollers.

U.S. Pat. No. 3,843,409 A describes a heat exchanger cleaning system having a boom. A cleaning head is supported on the boom by the cooperation of tracks mounted on the boom and a plurality of wheels mounted on the head.

U.S. Pat. No. 5,735,964 A describes an assembly for cleaning a tube bundle including a plurality of elongated tubular lances movable within an outer shell. A flexible fluid hose within the shell extends to the manifold in the lower portion of the assembly, which in turn transmits pressurized fluid to the plurality of lances. A hydraulic motor powers a rack and pinion assembly to reciprocate the lances. In an example, a hydraulic fluid line is provided for powering movement of the plurality of elongate tubular lances, and a flexible water pressure line is provided for transmitting pressurized water to the lances for conducting the cleaning operation.

SUMMARY OF THE INVENTION

It is an object of the present invention to provide a cleaning apparatus of the kind mentioned initially which has a high structural strength and allows for a high cleaning water output pressure.

A further object of the invention is to provide a cleaning apparatus of the kind mentioned initially which is easier to handle and which facilitates the manual work when cleaning a cooling tube array.

A further object of the invention is to provide a cleaning apparatus of the kind mentioned initially which is easy to assemble and/or arrange on site.

A further object of the invention is to provide a cleaning apparatus of the kind mentioned initially which simplifies the manufacturing thereof.

The invention is indicated in the independent claims. Further embodiments are indicated in the dependent claims.

In a first aspect of the invention, to better address one or more of these objects, there is provided a cleaning apparatus for cleaning a cooling tube array of a heat exchanger, comprising: a truss beam supported to be movable in a first direction, which direction is perpendicular to a longitudinal direction of the truss beam, a nozzle carriage movably held on the truss beam, the nozzle carriage being movable along the longitudinal direction of the truss beam, and a plurality of cleaning nozzles mounted to the nozzle carriage, wherein the truss beam comprises two parallel C-channel rails having back sides that face each other, a tube arranged separate and distant from the C-channel rails and at a different height than the C-channel rails in a cross-sectional plane of the truss beam, and truss supports arranged transverse to the C-channel rails and the tube, the truss supports connecting the rails and the tube, and wherein the nozzle carriage comprises rollers that are arranged for travelling in the C-channel rails. Here and in the following, the term "truss beam" includes a "truss assembly", and the terms are used interchangeably.

When water is ejected from the cleaning nozzles towards the cooling tube array in large amounts of e.g. 160 liters (or 43 gallons) per minute and with a supply pressure of e.g. 80 bar (or 1160 psi), large forces result that act on the nozzle carriage in the opposite direction. The rollers directly transfer the forces onto the C-channel rails of the truss beam, which are stabilized against bending and twisting by the structural strength of the truss beam that is provided by the network of the C-channel rails, the tube, and the truss supports connecting them. In particular, as the C-channel rails are connected by the truss supports, forces of the rollers may be taken up by the C-channel rails at laterally distant positions of the truss beam. Therefore, a torsional load of the C-channel rails may be reduced, and a high structural stability against turning and twisting of the C-channel rails may be provided. Still furthermore, by the tube being arranged at a different height and being connected to the C-channel rails by the truss supports, a high rigidity of the truss beam against bending upwards may be provided. Moreover, when the truss beam is made up from two C-channel rails and one tube, e.g. a rectangular tube such as a square tube, and truss supports, manufacturing of the truss beam is considerably simplified. In particular, C-channel rails and a rectangular tube may be provided as standardized material, and may easily be connected to the truss supports by welding. The truss supports are configured to stiffen the truss beam. The nozzle carriage is mounted to the truss beam by the rollers engaging the C-channel rails.

The tube and the C-channel rails together extend along the longitudinal direction of the truss beam. In other words, the tube and the C-channel rails are arranged next to each other in traverse directions.

The truss supports may include truss supports arranged at a respective end of the truss beam.

For example, each truss support may be arranged transverse to the C-channel rails and the tube, and may connect the rails and the tube.

Preferably, the cleaning apparatus comprises truss beam supports for supporting the truss beam to be moveable in the first direction, and wherein the truss supports connect the C-channel rails and the tube at intermediate positions between the truss beam supports.

Preferably, the tube is arranged above the C-channel rails, the C-channel rails and the tube being arranged in a triangular pattern in a cross sectional plane, the apex of the triangular structure pointing upwards.

Preferably, each of the truss supports directly connects each of the two C-channel rails to the tube. For example, the truss support may include one piece that is welded to both C-channel rails and to the tube. The piece is preferably plate-shaped.

Preferably, the truss supports are interior truss supports of the truss beam. In particular, they may be arranged to connect the rails and the tube within a region of the truss beam defined by the extension of the tube and the C-channel rails; thus, the region has a substantially triangular cross section. For example, the interior truss supports may be confined to said region.

Preferably, the truss supports connect the rails and the tube, forming a 3-dimensional open frame structure of the truss beam.

For example, the truss beam, in a cross section between the truss supports, may have the two C-channel rails and the one tube arranged in a triangle.

Preferably, in a cross section, the truss beam has only one tube connected by the truss supports to the rails.

Preferably, the C-channel rails are arranged on a left side and, respectively, a right side of the tube.

Preferably, the C-channel rails and portions of the truss supports form a planar open frame structure. For example, a 3-dimensional open frame structure formed by the truss supports, the C-channel rails, and the tube may include a planar open frame structure formed by the C-channel rails and first portions of the truss supports.

For example, the C-channel rails may be positioned at laterally outermost positions of the truss beam. For example, when the C-channel rails are arranged at laterally outermost positions of the 3-dimensional open frame structure or of the planar open frame structure, a comparatively wide basis, in the cross section of the truss beam, may be provided for taking up the forces of the rollers.

Preferably, the C-channel rails and the tube are arranged at positions forming, in a cross section of the truss beam, tips of a triangle, the positions of the C-channel rails corresponding to bottom corners of the triangle, and the position of the tube corresponding to a top corner of the triangle.

Preferably, the truss supports cross gaps between the C-channel rails and between the tube and each respective C-channel rail.

Preferably, the C-channel rails are arranged distant from each other and from the tube, wherein a minimum distance between the C-channel rails and between each C-channel rail and the tube is larger, e.g. by a factor of at least two or three, than a respective maximum extension of a respective cross section of each C-channel rail and of the tube.

Preferably, the truss supports are arranged successively at respective positions along the longitudinal direction of the truss beam, a distance between successive truss supports being larger than their maximum transverse extension between the C-channel rails and/or the tube. That is, preferably, a distance between successive truss supports is larger than a minimum distance between the C-channel rails and between each C-channel rail and the tube. Thus, a high structural stability may be achieved with comparatively few truss supports. This simplifies the manufacturing of the truss beam. For example, a distance between successive truss supports may be larger by at least a factor of two or three than their maximum transverse extension between the C-channel rails and/or the tube.

Preferably, the truss supports are arranged successively at respective positions along the longitudinal direction of the truss beam, a distance between successive truss supports being larger by at least a factor of two or three than a minimum distance between the C-channel rails and between each C-channel rail and the tube.

Preferably, the truss supports are connected to the C-channel rails at the back sides of the C-channel rails.

Preferably, the C-channel rails and the tube and, preferably, the truss supports, are made of aluminum, and, preferably, the truss supports are welded to the C-channel rails and to the tube.

Preferably, the tube is arranged above the C-channel rails. For example, the tube may be arranged centered above the C-channel rails. Although an arrangement of the tube below the C-channel rails might in general be considered to provide for a structure of the truss beam that is stable against downward deflection, arranging the tube above the C-channel rails has the particular advantages that it allows for a more compact and lighter nozzle carriage, and may improve the guidance of the nozzle carriage. In particular, the nozzles may then be mounted closer to the C-channel rails. Thus, the nozzle carriage may run smoothly even when the back pressure from spraying water varies dependent on the structure of the target.

Preferably, the truss supports have an inverted-T-shape, comprising a first (preferably horizontal) portion connecting the C-channel rails, and a second, upright portion extending from the middle of the first portion and connecting the first portion to the tube. Thus, a slim structure of the truss beam is made possible. For example, the C-channel rails and the respective first portions of the truss supports form a planar open frame structure having rectangular frame units or rectangular frame openings.

Preferably, an internal truss support connects both C-channel rails and the tube within a plane of the respective internal truss support.

Preferably, the truss supports are plate shaped, i.e. they are truss support plates. Thus, welding of the truss supports to the C-channel rails and to a rectangular tube is particularly simplified. In particular, the connections may include comparatively long rectilinear welding seams. Moreover, one-piece, plate-shaped truss supports may be simply manufactured. For example, the truss supports plates may each form a T-shaped plate or a triangular shaped plate. However, instead of being of plate shape, the truss supports may also be formed of round material such as cylindrical rods, and/or formed of tube sections, for example.

Preferably, the truss supports are connected to the back sides of the C-channel rails forming respective right angles in a plane including the C-channel rails. Preferably, the truss supports are connected to a lower side surface of the tube forming respective right angles with the tube when seen from the side. Preferably, the truss supports are arranged each in a cross-sectional plane of the truss beam, in particular in a plane perpendicular to the longitudinal direction of the C-channel rails and/or in a plane perpendicular to the longitudinal direction of the tube, or in a plane having an intermediate inclination between the inclinations of said planes; in the case that the tube is parallel to the C-channel rails, said planes are parallel to each other and, thus, have the same inclination. However, the truss supports may have different orientations. For example, the truss supports may extend diagonally between at least respective two of the tube and the C-channel rails.

The truss beam may comprise bracings that are inclined with respect to the truss supports. For example, at least one bracing may diagonally connect at least one truss support to the tube, forming a triangle structure. This may further improve the rigidity of the truss beam.

The C-channel rail has a C-shaped cross section. The rail has a back side, or bottom of the C-channel, and two flanges extending to a same side on opposite borders of the bottom. For example, both flanges may have a same width or extension length from the back side.

Preferably, respective axes of rotation of the rollers are arranged in said first direction. Typically, the first direction is a horizontal direction.

Preferably, the axes of rotation of the rollers each are transverse to (i.e. directed across) the back side of the associated C-channel rail, rather than transverse to the flanges of the C-channel rail. Thus, the rollers are configured to roll on a flange of a respective C-channel rail, not on a channel bottom.

For example, the rollers may have a flat circumferential surface configured to roll on a flat flange surface of the C-channel rail.

Preferably, the nozzle carriage comprises left and right side parts, on which left rollers and right rollers are mounted, respectively, the left rollers being arranged for traveling in a left C-channel rail of the C-channel rails, and the right rollers being arranged for traveling in a right C-channel rail of the C-channel rails, wherein the nozzle carriage further comprises a connection section that connects the left and right side parts below the truss beam. For example, the left and right side parts enclose between them a planar open frame structure formed by the C-channel rails and first portions of the truss supports. Thus, the rollers and C-channel rails may provide guidance to the nozzle carriage.

Preferably, side parts of the nozzle carriage have openings, which allow for the rollers to be withdrawn from the C-channel rails outwards in a side direction (along a rotation axis of the respective roller). For example, the rollers may be mounted on mounting plates that are attached to respective side parts of the nozzle carriage from the outside. For example, the mounting plates are spring biased towards a mounting position, in which the rollers are accommodated in the C-channel rails.

Preferably, the truss beam comprises at least two truss beam units connected in a row, wherein each truss beam unit may have a structure as explained above with respect to the truss beam. In particular, each truss beam unit comprises two parallel C-channel rails having back sides that face each other, a tube arranged separate and distant from the C-channel rails and at a different height than the C-channel rails in a cross-sectional plane of the truss beam, and truss supports arranged transverse to the C-channel rails and the tube, the truss supports connecting the rails and the tube, and wherein travelling paths of the respective rollers of the nozzle carriage along the truss beam extend over C-channel rails of adjoining truss beam units. Depending on the length of the truss beam, assembling the truss beam from segments (i.e. truss beam units) may facilitate handling and assembling/arranging the cleaning unit on site.

Preferably, the nozzle carriage comprises a guiding section that includes the rollers, and a first cantilever section that extends from the guiding section in a first travelling direction along the C-channel rails of the truss beam and that carries at least a first one of the cleaning nozzles, wherein a travelling range of the nozzle carriage along the C-channel rails of the truss beam includes a first position, in which first position the at least one first cleaning nozzle is positioned beyond the end of the C-channel rails of the truss beam. For example, the cantilever section may extend beyond a first end of the C-channel rails of the truss beam, in the first position, while the guiding section still completely overlaps with the C-channel rails. For example, the guiding section may be defined, in the travelling direction, by the rollers, i.e. it is a section in which the rollers provide guidance by engaging the C-channel rails. That is, the length of the is defined by the range that is spanned by the positions of the rollers.

Preferably, the nozzle carriage further comprises a second cantilever section that extends from the guiding section in a second travelling direction opposite the first travelling direction, and that carries at least a second one of the cleaning nozzles, wherein the travelling range of the nozzle carriage along the C-channel rails includes a second position, in which second position the at least one second cleaning nozzle is positioned beyond a second end of the C-channel rails opposite the first end.

Preferably, the nozzle carriage includes a nozzle connector that mounts the cleaning nozzles to the guiding section. For example, the nozzle connector may form the first and/or second cantilever section.

Preferably, the cleaning apparatus has a nozzle manifold including the cleaning nozzles. The nozzle manifold is arranged for communicating the cleaning nozzles with a water intake. For example, the nozzle carriage carries the nozzle manifold. For example, the cleaning nozzle may be mounted to the nozzle carriage by the manifold. For example, the first and/or second cantilever section may include the manifold. For example, the nozzle connector may be formed by the manifold.

In an embodiment, the cleaning apparatus comprises a truss beam top support, a truss beam bottom support, and at least one truss beam intermediate support, wherein the truss beam intermediate support comprises a left upright section, a right upright section, and a bridge section spanning a space between the left and right upright sections, wherein the nozzle carriage and cleaning nozzles are arranged for passing through the truss beam intermediate support (i.e. below the bridge section and between the left and right upright sections) when travelling along the truss beam in the longitudinal direction of the truss beam. Preferably, the truss beam is arranged below the bridge section. For example, the bridge section may be connected to the tube for supporting the truss beam. For example, the bridge section may be connected to a top surface of the tube. The truss beam top support and truss beam bottom support may also be termed first and second truss beam end supports.

The truss beam top support may have a similar configuration as the above described truss beam intermediate support. In an example, the cleaning apparatus may comprise the truss beam top support, and a truss beam bottom support, but no truss beam intermediate support therebetween. In other words, the truss beam may extend below and across the truss beam top support, and the nozzle carriage and at least one of the cleaning nozzles are arranged for passing through the truss beam top support (i.e. below the bridge section and between the left and right upright sections) when travelling along the truss beam in the longitudinal direction of the truss beam. For example, the at least one first or second cleaning nozzle may be arranged on the first or, respectively, second cantilever section of the nozzle carriage for passing through the truss beam top support when travelling to the first or, respectively, second position of the nozzle carriage.

In an embodiment, the cleaning apparatus comprises a drive belt that extends along the longitudinal direction of the truss beam, wherein the drive belt is coupled to the nozzle carriage for moving the nozzle carriage along the truss beam. For example, the cleaning apparatus comprises a motor, and the drive belt is arranged to be coupled to the motor.

Preferably, the cleaning nozzles are arranged to eject water in a direction that is perpendicular to said first direction and perpendicular to the longitudinal direction of the truss beam.

Preferably, said plurality of cleaning nozzles comprises at least one row of cleaning nozzles that are connected in parallel to a common supply tube that is arranged below the triangular truss beam and extends across the longitudinal direction of the truss beam.

Preferably, said plurality of cleaning nozzles comprises two rows of cleaning nozzles that extend across the longitudinal direction of the truss beam and are arranged, with respect to the longitudinal direction of the truss beam, in front of the rollers and behind the rollers, respectively, (i.e. outside the guidance section) such that the rollers are positioned, in said longitudinal direction, between the two rows of cleaning nozzles.

Preferably, at each C-channel rail, there are arranged two or more rollers for traveling in said C-channel rail. This permits for a smooth rolling motion along the truss beam, provides guidance, and prevents the nozzle carriage from getting stuck on the truss beam.

In a second aspect of the invention, to better address one or more of the objects, there is provided a cleaning apparatus for cleaning a cooling tube array of a heat exchanger, comprising: a truss beam supported to be movable in a first direction, which direction is perpendicular to a longitudinal direction of the truss beam, a nozzle carriage movably held on the truss beam, the nozzle carriage being movable along a nozzle carriage path in the longitudinal direction of the truss beam, a nozzle manifold having a plurality of cleaning nozzles that are mounted to the nozzle carriage, a water intake coupled to the nozzle manifold, and a hydraulic drive including a water inlet and a mechanical power take-off member, wherein the mechanical power take-off member is operably coupled to the nozzle carriage for moving (driving) the nozzle carriage along the nozzle carriage path, the water inlet being coupled to the water intake.

This is particularly advantageous, since the movement of the nozzle carriage along the truss beam, and the spraying, may then be water powered only. That is, in contrast to a conventional cleaning apparatus having an electric motor supplied with electric power from external, no electric cable is required to be carried along or unrolled when the truss beam is moved, for example, over a path of 100 meters in the first direction along the cooling tube array. Thus, handling of the cleaning apparatus is made much more simple, in particular in view of the large structures of cooling tube arrays of heat exchangers of power stations.

The mechanical power take-off member is operably coupled to the nozzle carriage for driving the nozzle carriage along the nozzle carriage path. In particular, mechanical power take-off member is energetically coupled to the nozzle carriage for driving the nozzle carriage along the nozzle carriage path. That is, movement of the nozzle carriage is powered, directly or indirectly, by the mechanical power take-off member, and, thus, by the hydraulic drive.

The hydraulic drive converts hydraulic power of a water flow entering through the water inlet into mechanical power, which is output by movement of the mechanical power take-off member. The hydraulic drive uses water as a working fluid. That is, the hydraulic drive is adapted to actuate a moving drive component (e.g. rotate an output shaft) solely powered by water supplied under pressure. The water is externally supplied to the cleaning apparatus through the water intake.

The hydraulic drive may use hydrostatic pressure for moving the mechanical power take-off member, and/or may use kinetic energy of the water flow for moving the mechanical power take-off member. In general, a driven side of the hydraulic drive (the power take-off member) is energetically coupled to the nozzle carriage, and a driving side of the hydraulic drive (the water inlet) is coupled to be in liquid communication with the water intake.

The term "operably coupled" or "energetically coupled" includes coupling via a hydraulic transmission system, coupling via a pneumatic transmission system, coupling via an electric system, coupling via a mechanical transmission, and direct mechanical coupling e.g. by the mechanical power take-off member being fixedly mounted to the nozzle carriage.

The water intake is a water intake for supplying water to the nozzle manifold. For example, water may be supplied to the water intake in large amounts of approximately 100-160 liters per minute at a supply pressure of around 60-80 bar.

Preferably, the cleaning apparatus is the cleaning apparatus according to the features as described above with respect to the first aspect of the invention, the truss beam being the truss beam described with respect to the first aspect of the invention. In other words, there is provided a cleaning apparatus for cleaning a cooling tube array of a heat exchanger, comprising: a truss beam supported to be movable in a first direction, which direction is perpendicular to a longitudinal direction of the truss beam, a nozzle carriage movably held on the truss beam, the nozzle carriage being movable along a nozzle carriage path in the longitudinal direction of the truss beam, a nozzle manifold having a plurality of cleaning nozzles that are mounted to the nozzle carriage, a water intake coupled to the nozzle manifold, and a hydraulic drive including a water inlet and a mechanical power take-off member, wherein the mechanical power take-off member is operably coupled to the nozzle carriage for driving the nozzle carriage along the nozzle carriage path, the water inlet being coupled to the water intake, wherein the truss beam comprises two parallel C-channel rails having back sides that face each other, a tube arranged separate and distant from the C-channel rails and at a different height than the C-channel rails in a cross-sectional plane of the truss beam, and truss supports arranged transverse to the C-channel rails and the tube, the truss supports connecting the rails and the tube, and wherein the nozzle carriage comprises rollers that are arranged for travelling in the C-channel rails. In the following, the term "truss beam" includes a "truss assembly".

Preferably, the mechanical power take-off member of the hydraulic drive is a rotary driven output shaft of the hydraulic drive.

Preferably, the cleaning apparatus further comprises a motor that is mechanically coupled to the nozzle carriage for driving the nozzle carriage along the nozzle carriage path, and a first transmission system that energetically couples the mechanical power take-off member of the hydraulic drive to the motor. That is, the motor is coupled to the nozzle carriage to perform relative movement between the nozzle carriage and the beam truss. Preferably, the motor is fixedly mounted to the beam truss (i.e. not to move together with the nozzle carriage along the nozzle carriage path), and the nozzle carriage moves along the nozzle carriage path with respect to the motor and the truss beam.

Preferably, the first transmission system is one of: a hydraulic transmission system, a pneumatic transmission system, and an electric system. Correspondingly, the motor is preferably one of: a hydraulic motor, a pneumatic motor, and an electric motor.

Preferably, the motor and/or first transmission system includes a reverse switch configured to revert a turning direction of the motor when a resistance against further movement of the nozzle carriage exceeds a predetermined threshold. However, the turning direction of the motor may also be reverted by manually switching a reverse switch, or by a reverse switch that is actuated by a limit switch or end position sensor.

Preferably, the first transmission system is a hydraulic transmission system, wherein the motor is a hydraulic motor, wherein the hydraulic transmission system includes a hydraulic pump.

The hydraulic transmission system (also termed a hydraulic circuit) operably couples the hydraulic drive, in particular a rotary driven output shaft of the hydraulic drive, to the hydraulic motor.

In particular, the hydraulic pump may be coupled, e.g. mechanically coupled, to a rotary driven output shaft of the hydraulic drive. That is, in particular, a pump drive shaft may be coupled to, or connected to, a driven shaft of the hydraulic drive.

Preferably, the hydraulic transmission system has a working fluid that is separated from a working fluid of the hydraulic drive, the working fluid of the hydraulic drive being water supplied through the water intake. For example, the working fluid of the hydraulic transmission system is hydraulic oil.

Preferably, the hydraulic transmission system further includes a hydraulic valve that couples the hydraulic pump to the hydraulic motor. Preferably, the hydraulic valve is configured for switching the direction of rotation of the hydraulic motor.

In an embodiment, the hydraulic valve has two work ports which are respectively connected to two ports of the hydraulic motor, an input port connected to an output port of the hydraulic pump, and a return port connected to an input port of the hydraulic pump, and wherein the hydraulic valve has at least two switching positions, wherein in a first switching position, the input port of the hydraulic valve is connected to the first work port, and wherein in a second switching position, the input port of the hydraulic valve is connected to the second work port.

Preferably, the hydraulic valve has at least three switching positions, wherein a third switching position is a stop switching position, in which the hydraulic motor is stopped. For example, the first and second work ports may be blocked in the third switching position.

Preferably, the hydraulic transmission system includes a buffer tank, which is connected to the input port of the hydraulic pump. For example, the return port of the hydraulic valve may be connected to the input port of the hydraulic pump via the buffer tank.

Preferably, external power supply to the cleaning apparatus for generating movement of the nozzle carriage along the nozzle carriage path is provided by a flow of pressurized water entering the cleaning apparatus through the water intake. For example, the movement of the nozzle carriage along the truss beam, and the spraying of water from the cleaning nozzles, is water powered only. In particular, the movement of the nozzle carriage along the nozzle carriage path may be water-powered only, through the hydraulic drive generating power from pressure and flow of a water flow entering the water inlet from the water intake.

Preferably, the hydraulic drive includes a housing, the water inlet, a water outlet, and a wheel rotatably arranged in the housing, wherein the mechanical power take-off member is an output shaft of the hydraulic drive, and wherein the wheel is coupled to the output shaft. For example, the wheel may be an impeller arranged to be rotated by water entering the hydraulic drive through the water inlet.

Preferably, the hydraulic drive includes a water outlet, and wherein the water outlet of the hydraulic drive is coupled to the nozzle manifold. Thus, at least a part of the water flow entering the cleaning apparatus is used to be sprayed from the nozzles. Thus, at least a part of the incoming water flow is fed through the hydraulic drive. For example, at least a major part of the incoming water will be used for cleaning. Only a minor part of the flow energy will be used to power the hydraulic drive, for example, less than 10%, less than 5%, or less than 1%.

Preferably, the nozzle manifold is coupled to the water intake of the cleaning apparatus through the hydraulic drive. In other words, all of the incoming water flow is fed through the hydraulic drive.

Preferably, the cleaning apparatus comprises: a second transmission system that mechanically couples a motor shaft of the motor to the nozzle carriage and that is configured for converting a rotary motion of the motor shaft of the motor into a force pulling the nozzle carriage in at least a first direction along the nozzle carriage path. In particular, the force may be a linear force.

Thus, the motor, which is mechanically coupled to the nozzle carriage for driving the nozzle carriage along the nozzle carriage path, has the motor shaft that is mechanically coupled to the nozzle carriage.

The second transmission system may include one of a belt drive (having a closed-loop belt, such as a rope drive or a toothed belt drive) and a reel, onto which one of a rope, a wire, and a cable is wound and/or is unwound from. The belt may form a loop around pulleys. The rope/wire/cable or similar does not form a closed-loop, but has e.g. one end connected to the nozzle carriage, and one end e.g. arranged on the reel. The rope is preferably a wire rope. Belt transmission systems are known in the art. As used in a conventional cleaning apparatus, the second transmission system may convert a rotary motion of the motor shaft into a linear motion of the nozzle carriage along the nozzle carriage path.

Preferably, the cleaning apparatus comprises limit switches or end position sensors arranged for being actuated when the nozzle carriage arrives at respective end positions. For example, the limit switches or end position sensors may be arranged at the nozzle carriage, at the truss beam, at the second transmission system, at the motor, and/or at the first transmission system. For example, the limit switches may be coupled to the motor and/or first transmission system for controlling the motor and/or first transmission system. For example, the motor and/or first transmission system may be configured for stopping and/or reversing the direction of movement of the nozzle carriage upon actuation of a limit switch.

Preferably, the cleaning apparatus further comprises a delay unit configured for starting a movement of the nozzle carriage in a first direction along the nozzle carriage path, when a predetermined delay time has elapsed after the nozzle carriage has arrived at an end position in a second direction opposite to the first direction. For example, the delay unit may be coupled to limit switches or end position sensors as mentioned above. For example, the predetermined time may be in the range of several seconds. This allows for moving the truss beam by approximately a cleaning swath width in the first direction, in order to clean the cooling tube array in successive, overlapping swaths or stripes. Preferably, the delay unit is a hydraulic delay unit, and preferably is a part of the hydraulic transmission system. However, since only little power is required for a delay unit, the delay unit may include an electric controller that may, for example, be battery powered. Also in case of an electric delay unit having a battery, the movement of the nozzle carriage and the spraying from the cleaning nozzles are preferably water powered only, as explained above.

In an embodiment, the mechanical power take-off member of the hydraulic drive is mechanically coupled to the nozzle carriage for driving the nozzle carriage along the nozzle carriage path. Preferably, the mechanical power take-off member is a motor shaft that is rotatable. The cleaning apparatus may include the second transmission system. The first transmission system is not needed. For example, the second transmission system may mechanically couple the motor shaft of the hydraulic drive to the nozzle carriage and may be configured for converting a rotary motion of the motor shaft of the hydraulic drive into a force pulling the nozzle carriage in at least a first direction along the nozzle carriage path.

Furthermore, there is provided a cleaning system for cleaning a cooling tube array of a heat exchanger, comprising the cleaning apparatus as described above, and wherein the cleaning system further comprises: a water supply pump positioned separate from the cleaning apparatus, and a tube (in particular, flexible tube), wherein the tube connects an output of the water supply pump to the water intake of the cleaning apparatus. Preferably, a length of the tube is at least four times the length of the truss beam, Preferably, the cleaning apparatus comprises a first truss beam end support, and a second truss beam end support, wherein the truss beam bridges a space between the first and second truss beam end supports. Thus, the truss beam may be positioned above and distant from the cooling tube array to be cleaned.

Preferably, the nozzle carriage is arranged below the truss beam.

Preferably, wherein when the nozzle carriage is positioned in the space between the first and second truss beam end supports, at least some of the plurality of cleaning nozzles are directed downwards within said space.

Preferably, the nozzle carriage path substantially extends from a first end of the truss beam to a second end of the truss beam. Preferably, the first truss beam end support is arranged at the first end of the truss beam, and the second truss beam end support is arranged at the second end of the truss beam. Preferably, the first truss beam end support is mounted to the truss beam at the first end of the truss beam, and the second truss beam end support is mounted to the truss beam at the second end of the truss beam.

Preferably, the truss beam comprises two parallel C-channel rails and truss supports cross-connecting the C-channel rails, wherein the nozzle carriage comprises rollers that are arranged for travelling in the C-channel rails. Thus, a light weight nozzle carriage is made possible.

Preferably, respective axes of rotation of the rollers are arranged in said first direction. Typically, the first direction is a horizontal direction.

The truss assembly or truss beam may be one of a triangular truss beam, a square truss beam, a ladder type structure comprising side walls/beams and ladder rungs, a truss assembly having C-shaped travelling profiles for guiding the nozzle carriage, etc. For example, the nozzle carriage may have rollers that are arranged for travelling on tubes of a truss beam, or that are arranged for travelling in travelling profiles of a truss assembly, e.g. C-shaped travelling profiles.

BRIEF DESCRIPTION OF THE DRAWINGS

The present invention will become more fully understood from the detailed description of preferred embodiments given herein below and the accompanying drawings, and wherein.

DETAILED DESCRIPTION

Figure 1:
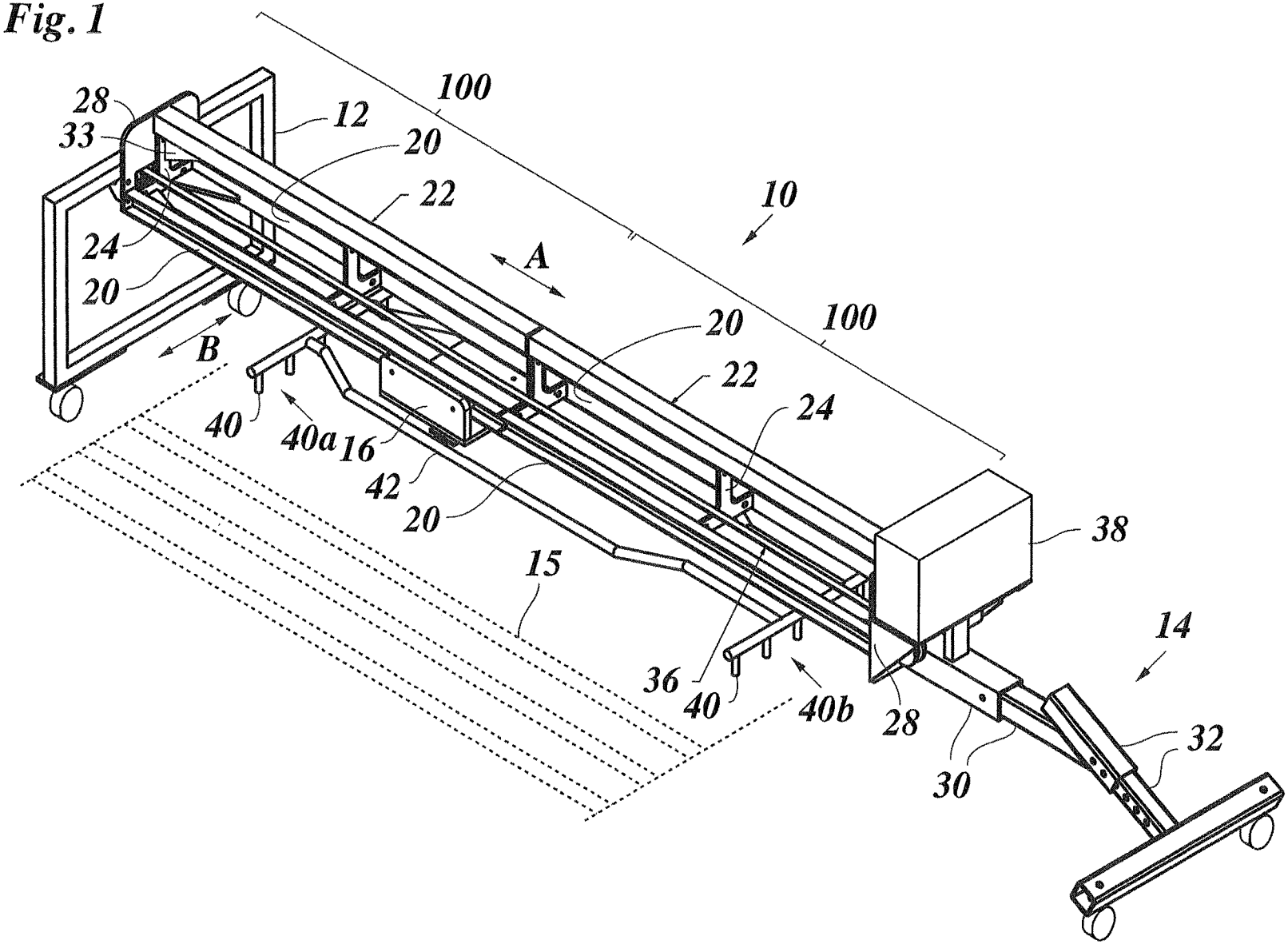
FIG. 1 is a schematic perspective view of a cleaning apparatus.

The cleaning apparatus shown in FIG. 1 is a cleaning apparatus for cleaning on site an outdoor cooling tube array of an outdoor heat exchanger. A truss beam in form of a truss assembly 10 is adapted for bridging a span between a first support 12 on a first end of the truss assembly 10 and a second support 14 on an opposite end of the truss assembly 10. Preferably, said span has a length of at least five meters, and may be e.g. in the range of 5 to 20 meters, e.g. 10 meters, 12 meters or 14 meters. For example, the truss assembly 10 may be arranged over a cooling tube array 15 that is inclined, the first support 12 being an upper support positioned at a high position on or above the inclined cooling tube array 15, and the second support 14 may be a lower support positioned at a low position next to a lower edge of the array 15, such that the truss assembly 10 extends across the cooling tube array 15.

The first and second supports 12, 14 are displaceable along the cooling tube array 15 in a horizontal direction B, i.e. perpendicular to the longitudinal direction A of the truss assembly 10, e.g. on rollers of the supports 12, 14. For example, the first and/or second supports 12, 14 may be guided on a respective rail. The inclination of the direction A is adapted to the inclination of the cooling tube array 15 to be cleaned.

On the truss assembly 10, i.e., suspended from the truss assembly 10, there is arranged a nozzle carriage 16. The carriage 16 is movable on a nozzle carriage path in the longitudinal direction A of the truss assembly 10.

The truss assembly 10 has one or more truss assembly units 100 arranged in a row, each having two parallel C-channel rails 20 and, distant from and centrally above the rails 20, a single square tube 22 also in parallel to the C-channel rails 20. The rails 20 and tube 22 are arranged in a triangular pattern, the apex of the triangular structure pointing upwards. For example, each truss assembly unit 100 has a length of at least two or three meters.

The C-channel rails 20 are arranged with their back sides facing each other. Thus, the C-channel rails 20 are open to the lateral left and right outer sides of the truss assembly 10.

Figure 3:
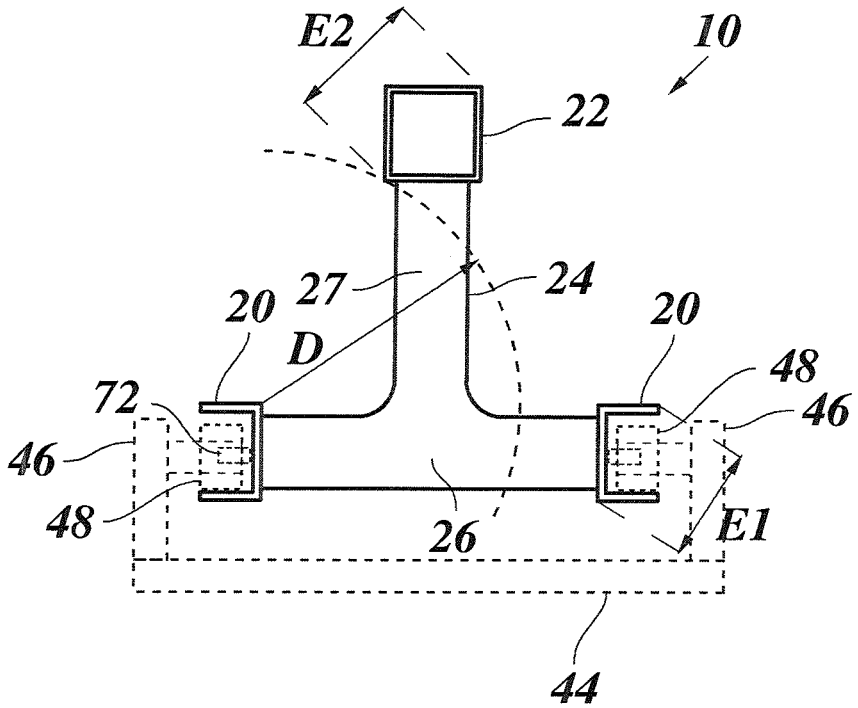
FIG. 3 is a schematic cross sectional view of a truss beam.

As shown in more detail in FIG. 3, the truss assembly unit 100 has interior truss supports 24 each in the form of an inverted T-shaped plate. An interior truss support 24 has a first portion 26 directly connecting the back sides of the C-channel rails 20.

Figure 2:
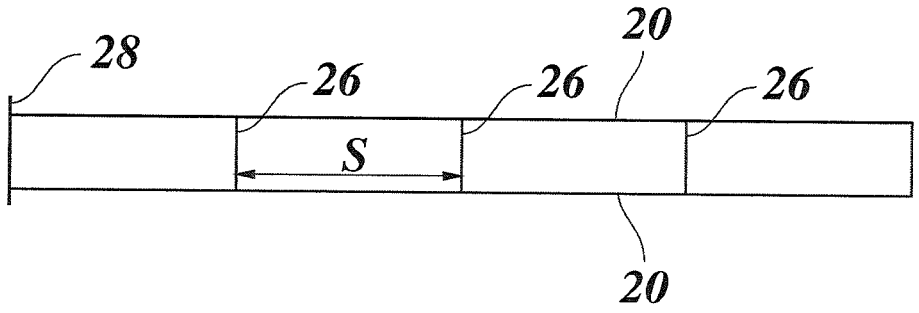
FIG. 2 is a schematic top view of a planar structure formed by parts of a truss beam.

As schematically shown in FIG. 2, the first portions 26 of the interior truss supports 24 together with the C-channel rails 20 form a planar, i.e. two-dimensional, rectangular frame structure having rectangular frame openings of longitudinal extension S. S is the distance between successive interior truss supports 24 as indicated in FIG. 2.

As shown in FIG. 3, the interior truss support 24 further has a second portion 27, corresponding to the stem of the T, which is connected to the lower surface of the square tube 22. Thus, the interior truss support 24 directly connects each of the C-channel rails 20 to the tube 22.

Reverting to FIG. 1, at the end of the truss assembly 10, the C-channel rails 20 and the tube 22 are connected to end connectors 28, e.g. via an internal truss support 24. The end connectors 28 are mounted to the supports 12, 14. For example, a bracing 33 that is inclined with respect to the internal truss support 24 diagonally connects the internal truss support 24 to the tube 22, forming a triangle structure. In the example of FIG. 1, the second support 14 exemplarily shows a length adjustment section 30 and a length/height adjustment section 32 each in the form of telescopic sections.

As shown in FIG. 1, multiple truss assembly units 100 may be coupled in lengthwise direction e.g. by fixing respective end interior truss supports 24 to each other, the C-channel rails 20 being connected so that the nozzle carriage 16 may travel in the longitudinal direction A along the C-channel rails 20 and across the connection of the units 100. Each truss assembly unit 100 may comprise at least two interior truss supports 24. For example, the truss assembly unit 100 may have two end truss supports 24 at opposite ends of the truss assembly unit 100, and none of, one or more, or two or more intermediate interior truss supports 24.

The nozzle carriage 16 is driven by a motor unit 38. For example, the nozzle carriage 16 may be connected to a belt 36 of a belt drive, which is driven by the motor unit 38.

Figure 4:
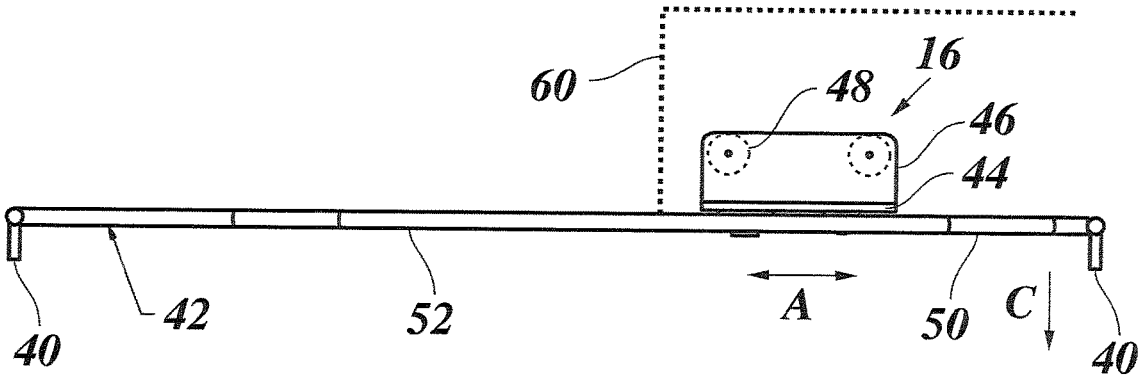
FIG. 4 is a schematic side view of a nozzle carriage, including a manifold with nozzles.

The nozzle carriage 16 is shown in detail in FIG. 1 and FIG. 4. From bottom to top, the nozzle carriage 16 comprises a plurality of nozzles 40, a manifold 42 in form of a generally rectangular frame tubing to which the nozzles 40 are connected in parallel, forming a nozzle array including at least a first row 40*a* and a second row 40*b*. The nozzles 40 are a part of the manifold 42. Then the manifold 42 is connected to the connection section 44, which connects left and right side parts 46 of the nozzle carriage 16. On each side part 46, rollers 48 are mounted. The axes of the rollers 48 extend in the direction B, perpendicular to the longitudinal direction A of the truss assembly 10.

As shown in FIG. 4, the manifold 42 is a nozzle connector, that connects the nozzles 40 to the connection section 44 of the nozzle carriage 16. The manifold 42, or connector, forms a first cantilever section 50 on the first support 12 side of the nozzle carriage 16, connecting the first row 40*a* of nozzles 40 to the connection section 44, and forms a second cantilever section 52 similarly connecting the second row 40*b* of nozzles 40 to the connection section 44 of the nozzle carriage 16. The cantilever sections 50, 52 are arranged below the connection section 44 and protrude, with respect to the connection section 44, in respective opposite travelling directions of the nozzle carriage 16, i.e. parallel to the direction A.

When the nozzle carriage 16 moves to a first end position close to the first support 12, the first cantilever section 50 extends through the first support 12, so that the first row 40*a* of nozzles 40 is positioned beyond the end of the truss assembly 10.

Likewise, when the nozzle carriage 16 moves to a second end position close to the second support 14, the second cantilever section 52 may extend to a position such that the second row 40*b* of nozzles 40 is positioned beyond the other end of the truss assembly 10. Thus, the cleaning range of the cleaning apparatus along the longitudinal direction A of the truss assembly 10 extends further than the extension of the truss assembly 10.

In particular, the nozzles 40 are arranged in two parallel rows 40*a*, 40*b* on straight sections on the rectangular frame tubing 42, which sections extend in a horizontal cross direction B that is perpendicular to the direction A. Nozzles have a common ejection direction C that is perpendicular to both directions A and B. The nozzles may e.g. be flat nozzles, circular nozzles, etc. When operating the cleaning apparatus, water is supplied to the nozzles 40 via at least one supply tube 60 and the manifold 42.

FIG. 3 shows a minimum distance D between the C-channel rails 20 and between each C-channel rail 20 and the tube 22. As shown in FIG. 2, the distance S between successive interior truss supports 24 is larger by at least a factor of two or three than the minimum distance D (S>2 D, or S>3 D).

FIG. 3 further shows a maximum extension E1 of a cross section of each C-channel rail 20 and a maximum extension E2 of a cross section of the tube 22. The minimum distance D between the C-channel rails and between each C-channel rail 20 and the tube 22 is larger by a factor of at least 1.5 than the maximum extension E1 of the cross section of each C-channel rail 20, and larger by a factor of at least 1.5 than the maximum extension E2 of a cross section of the tube 22 (D>1.5 E1; D>1.5 E2).

Figure 5:
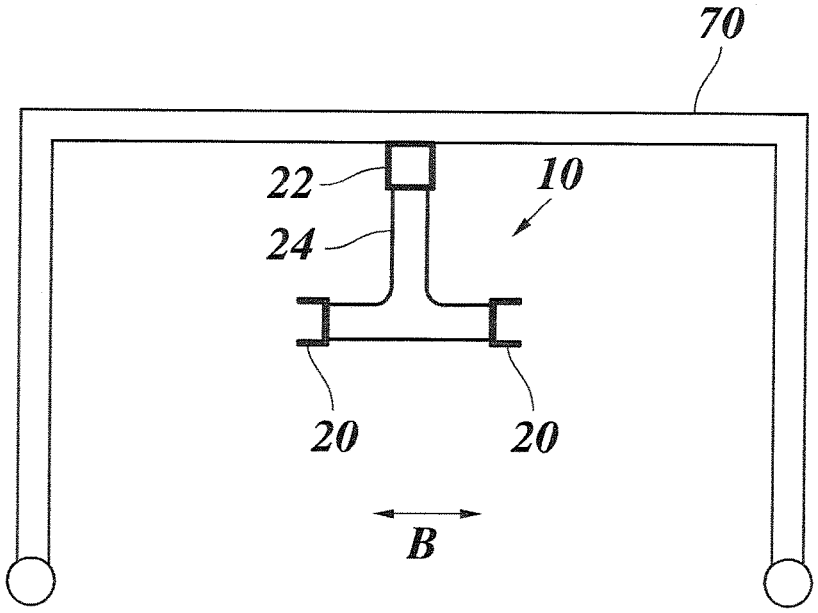
FIG. 5 schematically shows an intermediate support of a truss beam.

FIG. 5 shows an intermediate support of an embodiment. The intermediate support 70 may support the truss assembly 10 at an intermediate position between the ends of the truss assembly 10. Likewise, the intermediate support 70 may support a truss assembly unit 100 when there are multiple truss assembly units 100 connected in a line. As shown in FIG. 5, the intermediate support is attached to the tube 22 and extends in the direction B over the nozzle carriage 16 and nozzles 40. The nozzle carriage 16 is adapted to pass the intermediate support 70 when travelling along the truss assembly. Similar to the first support 12, the intermediate support 70 is a portal support.

The left and right side parts 46, the connection section 44, and the rollers 48 form a guiding section for guiding the nozzle carriage 16 along the truss assembly 10, by engaging the C-channel rails 20 with a predetermined clearance, as schematically shown in FIG. 3. In particular, when the pressure of the sprayed water presses the nozzle carriage 16 against the upper flanges of the C-channel rails 20, the rollers 48 may travel on the upper flanges of the C-channel rails 20, or may be guided between the upper and lower flanges of the C-channel rails 20. In a depressurized state of the nozzles 40, the rollers 48 may travel on the lower flanges of the C-channel rails 20. The cantilever sections 50, 52 are arranged to protrude, with respect to the guiding section, in respective opposite travelling directions of the nozzle carriage 16, i.e. parallel to the direction A. In particular, the cantilever sections 50, 52 protrude with respect to the positions of the rollers 48.

Figure 6:
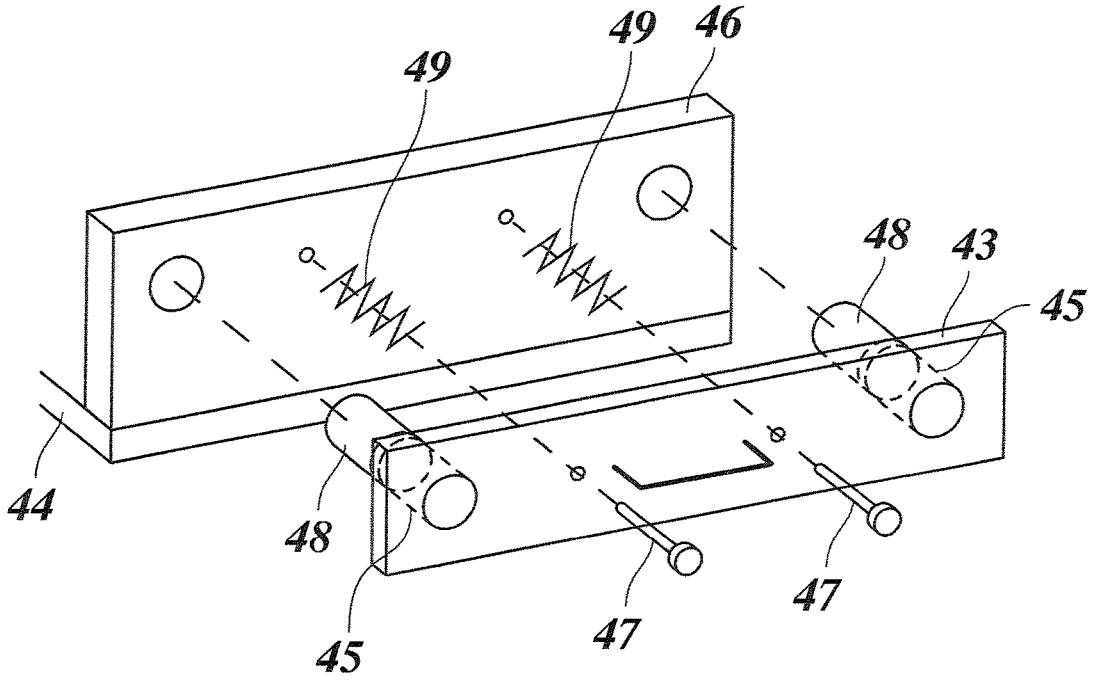
FIG. 6 is a schematic view of details of a nozzle carriage.

FIG. 6 shows details of an example of the nozzle carriage 16. The rollers 48 are mounted to a side part 46 of the nozzle carriage 16 as follows: The rollers 48, e.g. plastic wheels such as nylon wheels, are rotatably mounted to a mounting plate 43 through spacers 45. The mounting plate 43 is mounted to an outside of the side part 46, wherein the spacers 45 are accommodated in through-holes of the side part 46. That is, in a mounted state, the spacers 45, e.g. cylindrical spacers, penetrate the side part 46, wherein the mounting plate 43 is arranged at an outer side of the side part 46, and wherein the rollers 48 are arranged at an inner side of the side part 46, to be accommodated in the C-channel rails 20. The mounting plate 43 is spring biased by springs 49 towards the side part 46. Preferably, the mounting plate 43 is furthermore positively locked to the side part 46 of the nozzle carriage 16 by locking members, such as bolts 47. A handle is attached to the mounting plate 43. By unlocking the locking members and moving the mounting plate 43 with the rollers 48 outwards, the rollers 48 may be disengaged from the C-channel rails 20 towards the side. Thus, the nozzle carriage 16 may easily be mounted to and dismounted from the truss assembly 10 at any position.

In addition to the rollers 48, auxiliary rollers 72 may be mounted to the nozzle carriage 16 that travel on the bottom of the C-channel of the respective C-channel rail 20, as exemplarily shown in FIG. 3.

Figure 7:
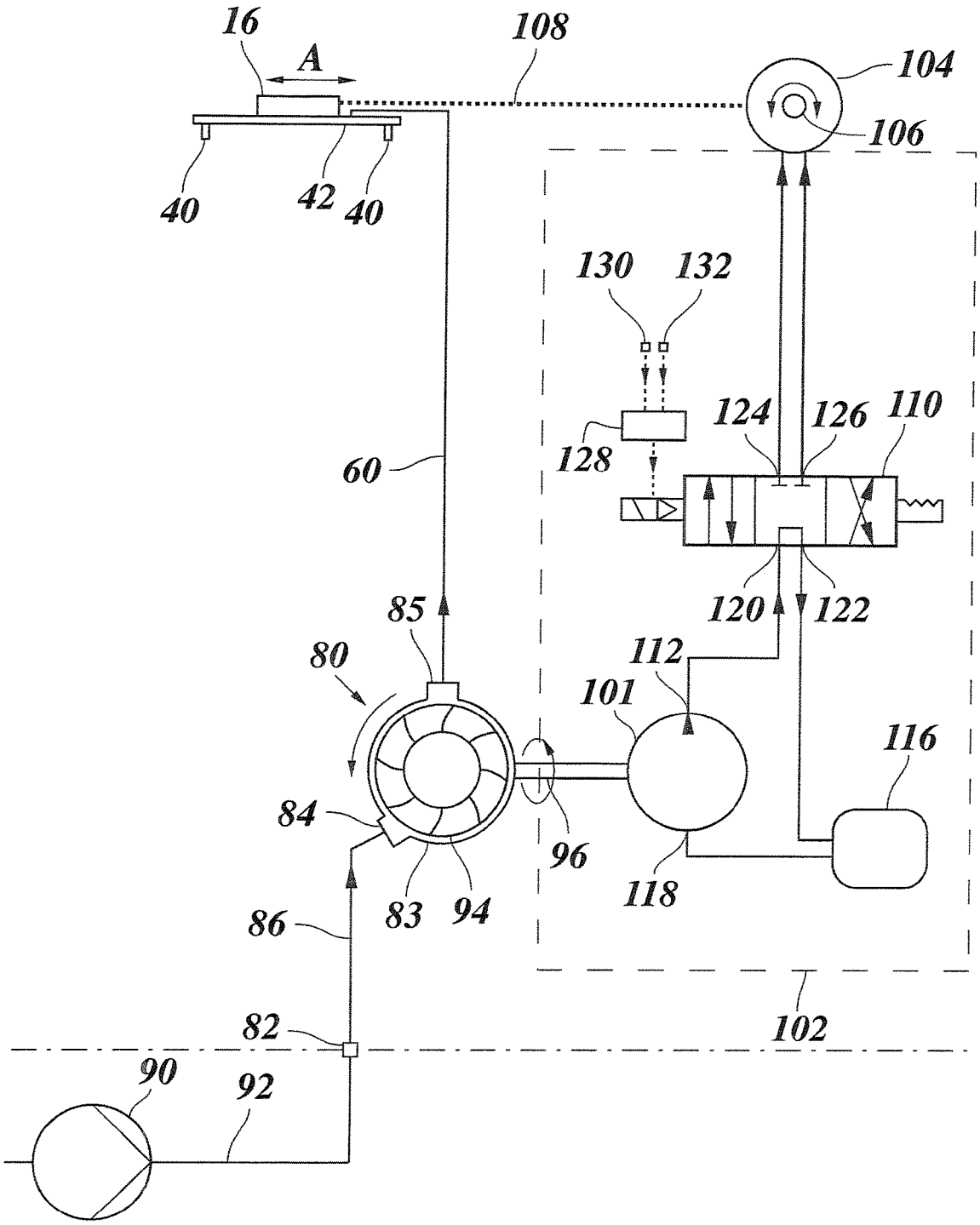
FIG. 7 is a schematic view of details of a cleaning apparatus having a hydraulic drive and a hydraulic transmission system.

FIG. 7 shows details of a cleaning apparatus having a hydraulic drive. For example, the cleaning apparatus may correspond to the cleaning apparatus of FIGS. 1 to 5. However, the nozzle carriage 16 and the truss beam or truss assembly 10 may also have a different structure.

The cleaning apparatus includes a hydraulic drive 80 that connects a water intake 82 to the water supply tube 60. In detail, the hydraulic drive 80 has a housing 83, a water inlet 84 and a water outlet 85. A water supply line 86 connects the water intake 82 to the water inlet 84. The supply tube 60 connects the water outlet 85 to the nozzle manifold 42 of the nozzle carriage 16 and, thus, to the nozzles 40. The water intake 82 may be arranged directly at the water inlet 84 of the hydraulic drive 80.

FIG. 7 also shows a cleaning system that includes the cleaning apparatus and, external to the cleaning apparatus, a water supply pump 90 and a flexible tube 92 that connects an output of the water supply pump 90 to a water intake 82 of the cleaning apparatus. In FIG. 7, a chain dotted line separates the components of the cleaning apparatus from the external components of the cleaning system. The cleaning system is a cleaning system for cleaning a cooling array 15 of a heat exchanger. The length of the tube 92 preferably is at least four times the length of the truss beam or truss assembly 10. For example, the length of the tube may be more than 50 meters, or more than 80 meters.

Reverting to the cleaning apparatus of FIG. 7, the hydraulic drive 80 has a wheel 94 with blades, the wheel being rotatably arranged in the housing 83 and connected to an output shaft 96 of the hydraulic drive 80. For example, the wheel 94 is an impeller. The output shaft is rotatable together with the wheel 94 and forms a mechanical power take-off member 96 of the hydraulic drive 80.

In operation, a water flow flows from the water intake 82 via the water inlet 84 through the hydraulic drive 80 to the water outlet 85 and sets the wheel 94 into rotation. The water that is output from the water outlet 85 still has a high pressure that is sufficient for performing the cleaning operation by the cleaning nozzles 40.

The output shaft 96 is connected to an input shaft of a hydraulic pump 101 of a closed circuit hydraulic circuit that forms a first transmission system 102 that operably couples the output shaft 96, i.e. the mechanical power take-off member 96 of the hydraulic drive 80, to a hydraulic motor 104. The hydraulic motor 104 has a motor shaft 106 that is operably coupled through a second transmission system 108 to the nozzle carriage 16 for moving the nozzle carriage 16 along the nozzle carriage path in the longitudinal direction A. The hydraulic motor 104 is part of the motor unit 38 shown in FIG. 1. For example, the second transmission system 108 includes the belt 36 and respective pulleys around which the belt 36 runs.

The hydraulic circuit includes a hydraulic valve 110 that couples an output port 112 of the hydraulic pump 101 to the hydraulic motor 104. The hydraulic circuit further includes a buffer tank 116, which is connected to an input port 118 of the hydraulic pump 101.

The hydraulic valve 110 has an input port 120, a return port 122, and two work ports 124, 126. The two work ports 124, 126 are connected to respective work ports of the hydraulic motor 104. The output port 112 of the hydraulic pump 101 is connected to the input port 120 of the hydraulic valve 110. The return port 122 of the hydraulic valve 110 is connected to the buffer tank 116 and, though the buffer tank 116, to the input port 118 of the hydraulic pump 101. In FIG. 7, respective connection lines of the hydraulic circuit are shown.

The hydraulic valve 110 is a three-position valve. In a first position of the valve, the input port 120 and the return port 122 are respectively connected to the work ports 124, 126, causing the hydraulic motor 104 to rotate in a first rotation direction. In a second switching position of the valve, these connections are switched, i.e. exchanged. That is, the input port 120 is connected to the other work port 126. Likewise, the return port 122 is connected to the work port 124. This causes the hydraulic motor 104 to rotate in an opposite rotation direction.

In a third switching position of the valve, the work ports 124, 126 are blocked, corresponding to a braking or stop state of the hydraulic motor 104. Thus, the third switching position is a stop switching position, in which the hydraulic motor 104 is stopped.

In FIG. 7, in detail, a first hydraulic line connects the output port 112 to the input port 120 of the valve 110, a second hydraulic line connects the return port 122 to the buffer tank 116. A third hydraulic line connects the buffer tank 116 to the input port 118. A fourth hydraulic line connects a first work port 124 of the valve 110 to a first work port of the motor 104. A fifth hydraulic line connects the second work port 126 of the valve 110 to a second work port of the hydraulic motor 104. Whereas the example shows two lines connected to the buffer tank 116, it may be sufficient to provide for a branch line that connects the second and third hydraulic lines (which in series connect the return port 122 of the valve 110 to the input port 118) to the buffer tank 116.

In the example shown, the valve 110 is electrically actuated. A delay unit 128 controls the actuation of the hydraulic valve 110. In particular, limit switches in the form of position sensors 130, 132 are connected via respective signal lines 134 to the delay unit 128.

Figure 8:
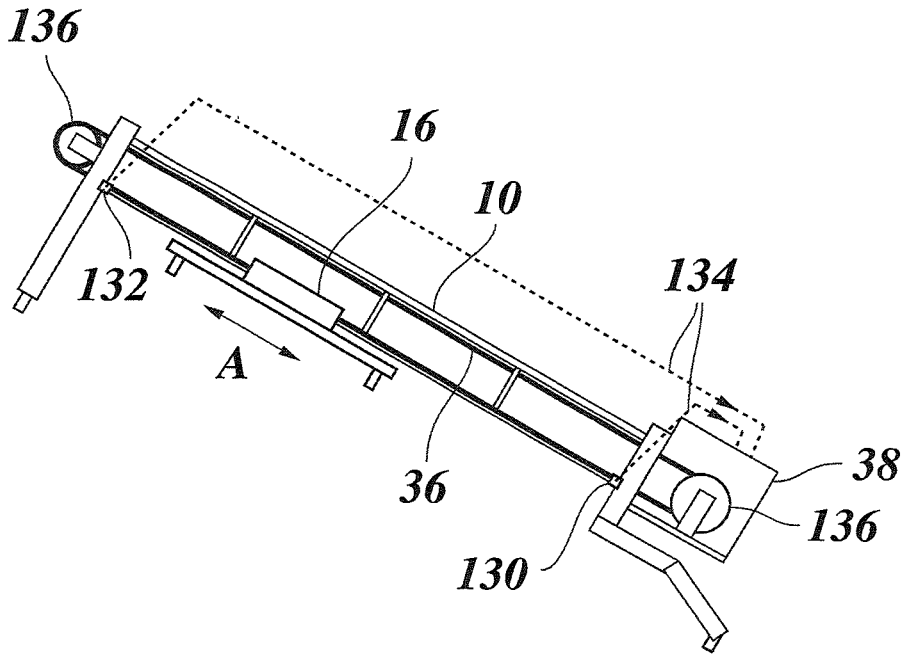
FIG. 8 is a schematic view of a cleaning apparatus having a transmission belt.

FIG. 8 shows an example of an arrangement of limit switches or end position sensors 130, 132 at the truss beam. When the nozzle carriage 16 travels in a first direction and arrives at the first end position sensor 130, the delay unit 128 starts a movement of the nozzle carriage 16 in the opposite direction, after a predetermined delay time has been lapsed. For example, the delay time may be set in the range of at least 5 seconds to at least 30 seconds. Likewise, when the nozzle carriage 16 has reached the other end position sensor 132, the hydraulic motor 104 is stopped, and, after a predetermined delay time, the hydraulic motor 104 is switched to the opposite rotation direction, so that the nozzle carriage 16 moves back in the opposite direction along the nozzle carriage path. For example, the delay time may be set to be sufficient for manually moving the cleaning apparatus in the direction B by a cleaning swath width of the nozzle array. However, in another example, a delay time between switching the directions of movement of the nozzle carriage 16 may be provided at only one end position of the nozzle carriage 16. Thus, at the other end position, the nozzle carriage 16 may return immediately. Moreover, different delay times may be set for the different end positions.

In the example of the cleaning apparatus according to FIG. 8, the motor unit 38 is operably coupled to the nozzle carriage 16 by the belt 36 running on pulleys 136, corresponding to the example of FIG. 1.

Figure 9:
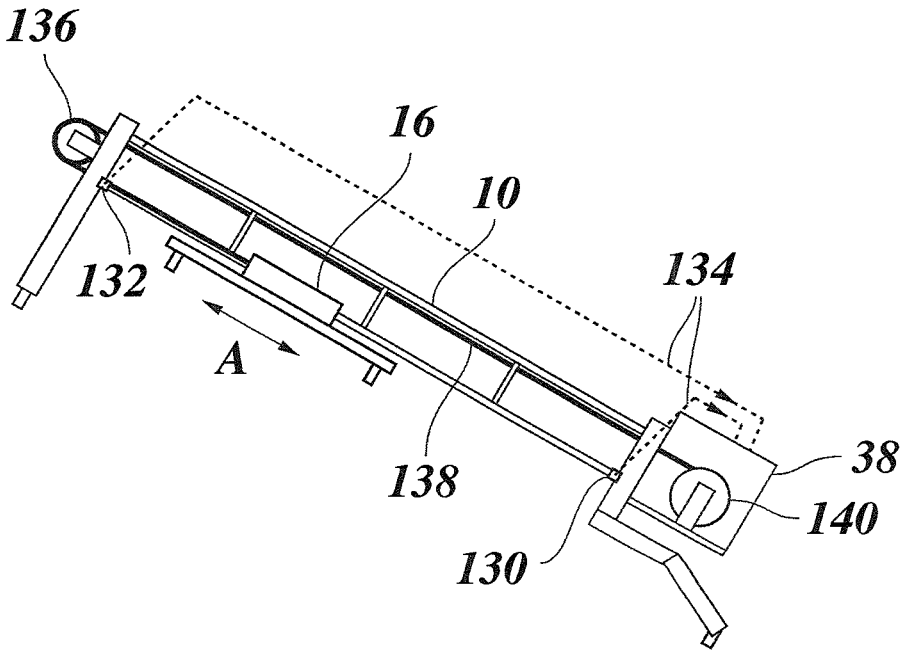
FIG. 9 is a schematic view of a cleaning apparatus having a transmission rope.

In another example, as shown in FIG. 9, the motor shaft 106 of the hydraulic motor 104 is mechanically coupled to the nozzle carriage 16 by a cable or wire rope 138. For example, the motor 104 is coupled to a reel 140 configured to wind up and unwind the rope 138. For example, the rope 138 runs around a pulley 136 at the opposite end of the truss beam. An end of the rope 138 is connected to the nozzle carriage 16. Thus, the rope 138 and pulley 136, together with the reel 140, form a second transmission system that converts a rotary motion of the motor shaft 106 into a linear force pulling the nozzle carriage 16 in a direction along the nozzle path towards the pulley 136. For example, as shown in FIG. 9, the motor 104 may pull the nozzle carriage 16 upwards in a tilted or vertical orientation of the truss beam 10. That is, the direction towards a first end of the truss beam will be termed "upwards". By unwinding the rope 136, the motor 104 controls downward movements of the nozzle carriage 16 by gravity acting on the nozzle carriage 16.

In another example, the first transmission system 102 may be a pneumatic circuit that may be configured similar to what is shown in FIG. 7. Thus, the pneumatic circuit may include a pneumatic pump 101, a pneumatic valve 110, and an pneumatic motor 104.

Figure 10:
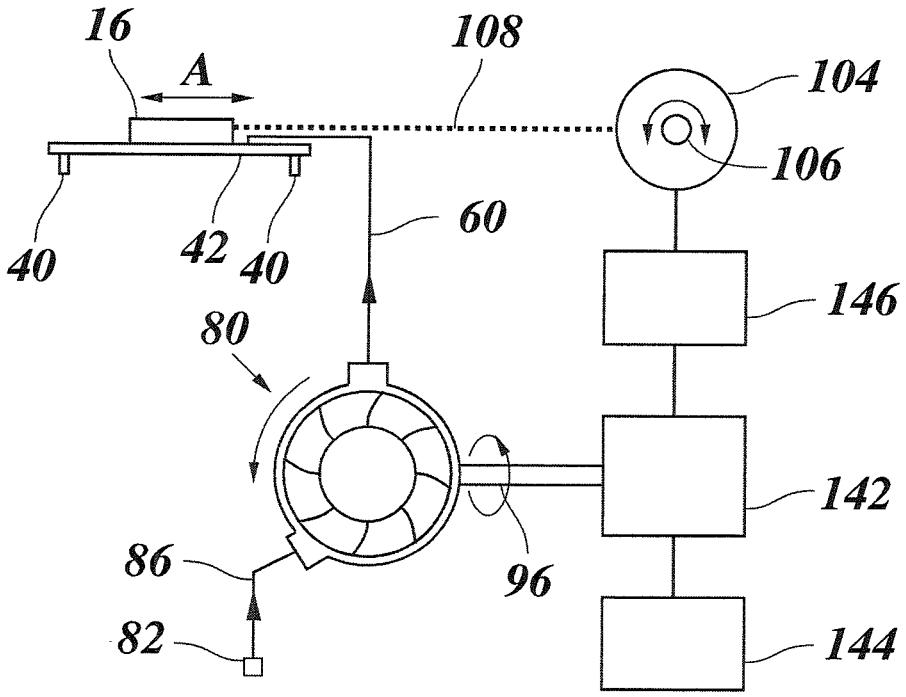
FIG. 10 is a schematic view of details of a cleaning apparatus having a hydraulic drive and an electric transmission system.

Still furthermore, in another example, as shown in FIG. 10, the first transmission system 102 may be an electric transmission system. Thus, an electric generator 142 may be operably connected to the output shaft 96 of the hydraulic drive 30. The electric circuit may include an energy buffer 144 and a delay unit 146 for controlling rotational motion of an electric motor 104 that is mechanically coupled to the nozzle carriage 16, for example by the second transmission system 108.

Figure 11:
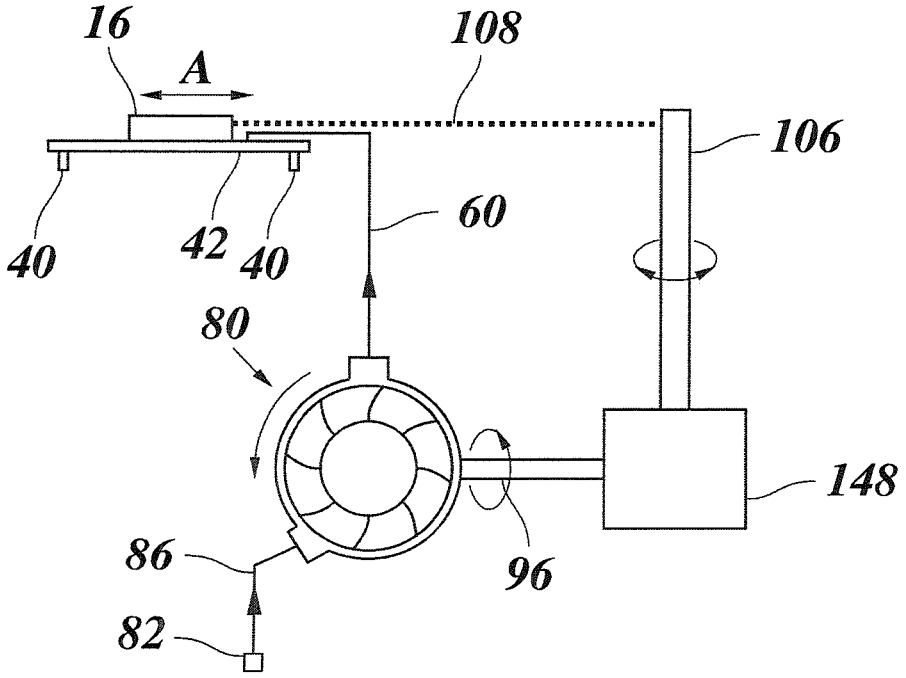
FIG. 11 is a schematic view of details of a cleaning apparatus having a hydraulic drive and a mechanical transmission system.

Still furthermore, in another example, as shown in FIG. 11, the first transmission system 102 may be a mechanical transmission 148 or gearbox operably coupling the output shaft 96 of the hydraulic drive 80 to a rotatable shaft 106 that is coupled to the nozzle carriage 16, for example, by the second transmission system 108. The mechanical transmission 148 may include a switching unit for switching the direction of rotation of the shaft 106.

Figure 12:
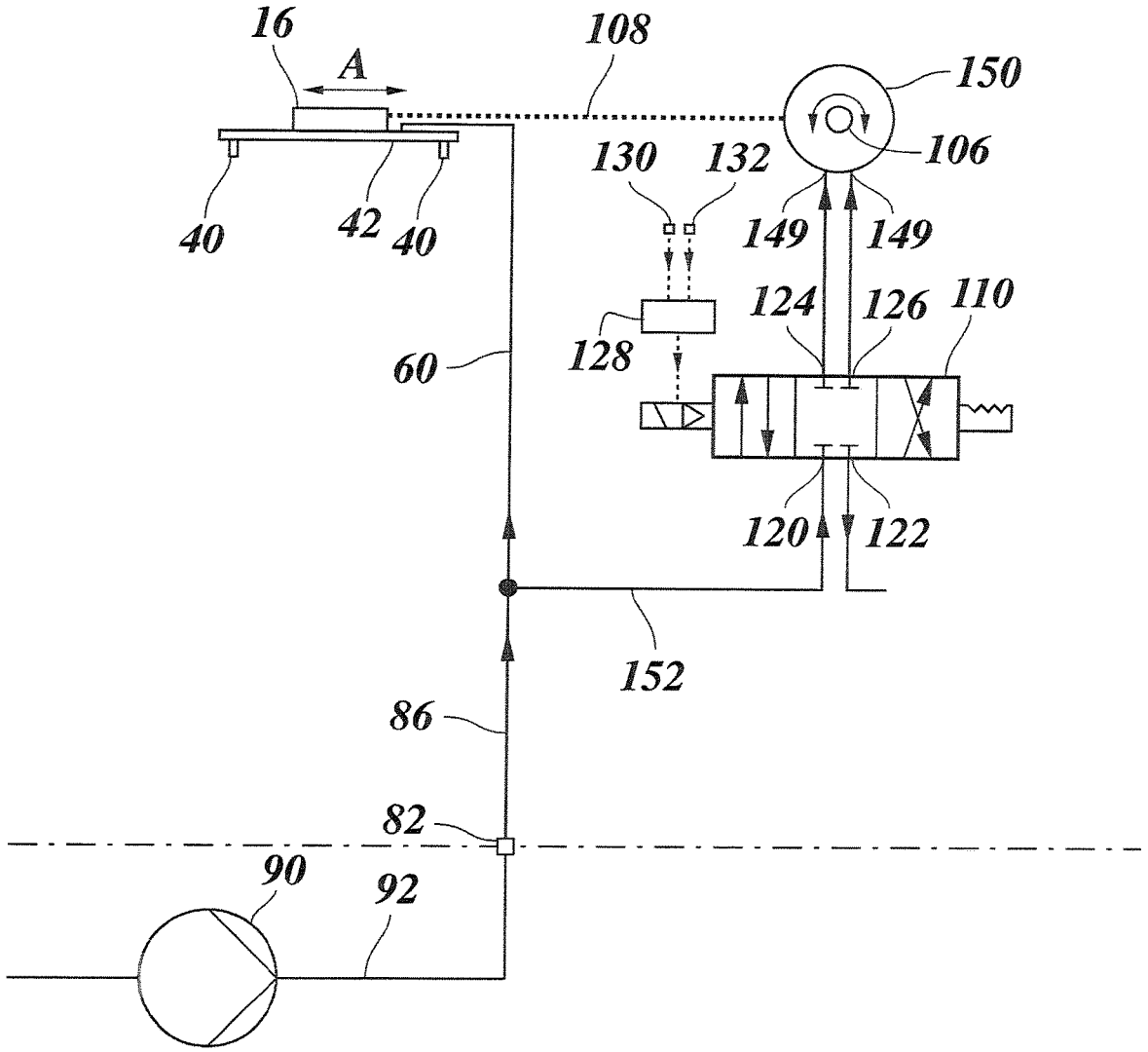
FIG. 12 is a schematic view of details of a cleaning apparatus having a hydraulic motor using water as a working fluid.

FIG. 12 shows another example of details of a cleaning apparatus. In this example, the water intake 82 is coupled to the nozzle manifold 42 of the nozzle carriage 16 and is coupled via a hydraulic valve 110 to a selectable one of water inlets 149 of a hydraulic drive 150 that uses water as an operating fluid. Also, the hydraulic valve 110 uses the water as a working fluid. The hydraulic drive 150 is a hydraulic motor. Similar to the hydraulic motor 104 of FIG. 7, the hydraulic drive 150 has a motor shaft 106 that is coupled, for example via the second transmission system 108, to the nozzle carriage 16 for converting a rotary motion of the motor shaft 106 of the hydraulic drive 150 into a force pulling the nozzle carriage 16 in at least a first direction along the nozzle carriage path. The rotatable shaft 106 is a mechanical power take-off member of the hydraulic drive 150. Similar to the hydraulic drive 80, the hydraulic drive 150 includes a wheel 94 or impeller rotatably coupled to the motor shaft 106. In the example shown, the water hydraulic circuit that includes the hydraulic valve 110 and the hydraulic drive 150 is an open circuit. The hydraulic valve 110 is similar to that of FIG. 7 and has the first and second switching positions for selectively coupling one of the water inlets 149 of the hydraulic drive to the water intake 82.

In the example of FIG. 12, in operation, the water supply line 86 branches into the supply tube 60 and a branch line 152 that diverts a part of the incoming water flow to the hydraulic valve 110 and hydraulic drive 150. Similar to FIG. 7, in FIG. 12, the components external to the cleaning apparatus are shown below the chain dotted line.

Whereas each cleaning apparatus described above may be assembled on site and e.g. temporarily mounted on a cooling tube array, the cleaning apparatus may also be permanently mounted to a heat exchanger to be displaceable over a cooling tube array.

In the examples, instead of the electric delay unit 128, which may be battery powered, the first transmission system 102 may include a different type of delay unit. For example, the hydraulic circuit may include a hydraulic delay unit.

In the examples, the valve 110 may be a manually controlled valve.

In the examples, instead of the end position sensors 130, 132 being arranged at end positions of the nozzle carriage 16 belong the nozzle carriage path, the end position sensors or limit switches may also be arranged at the motor unit 38. For example, an end position sensor 130 may detect opposite end positions. For example, end positions may be marked by flags on the belt 36 to be detected by an end position sensor 130. Furthermore, for example, an end position sensor 130 or limit switch may be provided in form of a pressure sensor at the hydraulic circuit of FIG. 7. Thus, an end position sensor 130 or limit switch may be arranged at the hydraulic motor 104, or, for example, at a hydraulic line connecting a working port of the hydraulic valve 110 to the hydraulic motor 104. For example, the end position sensor may be arranged for detecting an increasing hydraulic pressure when the hydraulic motor 104 stops when the nozzle carriage 16 has reached a stop at an end position. Instead of sensors 130, 132 at the positions shown in FIG. 8, there may be arranged stops at similar positions which block the nozzle carriage 16 from moving further. The delay unit 128 with the end position sensor 130 in the form of the pressure sensor, and the valve 110 together form a reverse switch configured to revert a turning direction of the motor 104 when a resistance against further movement of the nozzle carriage exceeds a predetermined threshold.

As the truss assembly has the tube 122 arranged above the C-channel rails 20, a light weight nozzle carriage 16 may be realized. Thus, the power requirements for moving the nozzle carriage 16 may be reduced. Therefore, it is particularly advantageous to provide for the hydraulic drive, which can easily provide enough output power at the mechanical power take-off member, such as the output shaft 96 or the output shaft 106. Thus, as shown in the examples of FIG. 7 and FIG. 12, no external electricity power supply is required for operating the cleaning apparatus. It is sufficient to provide the high pressure water flow through the tube 92 for performing the movement of the nozzle carriage along the longitudinal direction A, as well as the spraying operation of the nozzles 40.

Other variations to the disclosed embodiments can be understood and effected by those skilled in the art in practicing the claimed invention, from a study of the drawings, the disclosure, and the appended claims. Furthermore, all the disclosed elements and features of each disclosed embodiment of the cleaning apparatus can be combined with, or substituted for, the disclosed elements and features of every other disclosed embodiment of the cleaning apparatus, respectively, except where such elements or features are mutually exclusive.

The mere fact that certain measures are recited in mutually different dependent claims does not indicate that a combination of these measured cannot be used to advantage.

In the claims, the word "comprising" does not exclude other elements or steps, and the indefinite article "a" or "an" does not exclude a plurality. Any reference signs in the claims should not be construed as limiting the scope.

What is claimed is:

1. A cleaning apparatus for cleaning a cooling tube array of a heat exchanger, comprising:

a truss beam supported to be movable in a first direction, which direction is perpendicular to a longitudinal direction of the truss beam, a nozzle carriage movably held on the truss beam, the nozzle carriage being movable along the longitudinal direction of the truss beam, and a plurality of cleaning nozzles mounted to the nozzle carriage, wherein the truss beam comprises two parallel C-channel rails having back sides that face each other, a tube arranged separate and distant from the C-channel rails and at a different height than the C-channel rails in a cross-sectional plane of the truss beam, and truss supports arranged transverse to the C-channel rails and the tube, the truss supports connecting the rails and the tube, and wherein the nozzle carriage comprises rollers that are arranged for travelling in the C-channel rails.

2. The cleaning apparatus according to claim 1, wherein the tube is arranged above the C-channel rails, imaginary lines connecting the C-channel rails and the tube being arranged in a triangular pattern in a cross sectional plane, the triangular pattern having an apex pointing upwards.

3. The cleaning apparatus according to claim 1, wherein each of the truss supports directly connects each of the two C-channel rails to the tube.

4. The cleaning apparatus according to claim 1, wherein:

the truss supports are spaced apart from each other, the truss supports include first portions, the C-channel rails are spaced apart from each other, and the spaced apart C-channel rails and the first portions of the spaced apart truss supports form a planar open frame structure defined in a plan view by openings between spaced apart ones of the first portions of the truss supports and spaced apart C-channel rails.

5. The cleaning apparatus according to claim 1, wherein the truss supports are connected to the C-channel rails at the back sides of the C-channel rails.

6. The cleaning apparatus according to claim 1, wherein the truss supports have an inverted-T-shape, comprising a first portion connecting the C-channel rails, and a second, upright portion extending from the middle of the first portion and connecting the first portion to the tube.

7. The cleaning apparatus according to claim 1, wherein the nozzle carriage comprises left and right side parts, on which left rollers and right rollers are mounted, respectively, the left rollers being arranged for traveling in a left C-channel rail of the C-channel rails, and the right rollers being arranged for traveling in a right C-channel rail of the C-channel rails, wherein the nozzle carriage further comprises a connection section that connects the left and right side parts below the truss beam.

8. The cleaning apparatus according to claim 1, wherein the truss beam comprises at least two truss beam units connected in a row, wherein each truss beam unit comprises two parallel C-channel rails having back sides that face each other, a tube arranged separate and distant from the C-channel rails and at a different height than the C-channel rails in a cross-sectional plane of the truss beam, and truss supports arranged transverse to the C-channel rails and the tube, the truss supports connecting the rails and the tube, and wherein travelling paths of the respective rollers of the nozzle carriage along the truss beam extend over C-channel rails of adjoining truss beam units.

9. The cleaning apparatus according to claim 1, comprising a truss beam top support, a truss beam bottom support, and at least one truss beam intermediate support, wherein the truss beam intermediate support comprises a left upright section, a right upright section, and a bridge section spanning a space between the left and right upright sections, wherein the nozzle carriage and cleaning nozzles are arranged for passing through the truss beam intermediate support when travelling along the truss beam in the longitudinal direction of the truss beam.

10. A cleaning apparatus for cleaning a cooling tube array of a heat exchanger, comprising:

a truss beam supported to be movable in a first direction, which direction is perpendicular to a longitudinal direction of the truss beam, a nozzle carriage movably held on the truss beam, the nozzle carriage being movable along a nozzle carriage path in the longitudinal direction of the truss beam, a nozzle manifold having a plurality of cleaning nozzles that are mounted to the nozzle carriage, a water intake coupled to the nozzle manifold, and a hydraulic drive including a water inlet and a mechanical power take-off member, wherein the mechanical power take-off member is provided at a driven side of the hydraulic drive and is operably coupled to the nozzle carriage for moving the nozzle carriage along the nozzle carriage path, the water inlet being coupled to the water intake.

11. The cleaning apparatus according to claim 10, wherein the truss beam is a truss beam that comprises two parallel C-channel rails having back sides that face each other, a tube arranged separate and distant from the C-channel rails and at a different height than the C-channel rails in a cross-sectional plane of the truss beam, and truss supports arranged transverse to the C-channel rails and the tube, the truss supports connecting the rails and the tube, and wherein the nozzle carriage comprises rollers that are arranged for travelling in the C-channel rails.

12. The cleaning apparatus according to claim 10, wherein the hydraulic drive includes a housing, the water inlet, a water outlet, and a wheel rotatably arranged in the housing, wherein the mechanical power take-off member of the hydraulic drive is a rotary driven output shaft of the hydraulic drive, and wherein the wheel is coupled to the output shaft.

13. The cleaning apparatus according to claim 10, further comprising:

a motor that is mechanically coupled to the nozzle carriage for driving the nozzle carriage along the nozzle carriage path, and a first transmission system that energetically couples the mechanical power take-off member of the hydraulic drive to the motor.

14. The cleaning apparatus according to claim 13, wherein the first transmission system is a hydraulic transmission system, wherein the motor is a hydraulic motor, wherein the hydraulic transmission system includes a hydraulic pump.

15. The cleaning apparatus according to claim 14, wherein the hydraulic transmission system further includes a hydraulic valve that couples the hydraulic pump to the hydraulic motor, wherein the hydraulic valve has first and second work ports which are respectively connected to two ports of the hydraulic motor, an input port connected to an output port of the hydraulic pump, and a return port connected to an input port of the hydraulic pump, and wherein the hydraulic valve has at least two switching positions, wherein in a first switching position, the input port of the hydraulic valve is connected to the first work port, and wherein in a second switching position, the input port of the hydraulic valve is connected to the second work port, whereby the hydraulic valve is configured for switching the direction of rotation of the hydraulic motor.

16. The cleaning apparatus according to claim 10, wherein the hydraulic drive includes a water outlet, and wherein the water outlet of the hydraulic drive is coupled to the nozzle manifold.

17. The cleaning apparatus according to claim 10, wherein the nozzle manifold is coupled to the water intake of the cleaning apparatus through the hydraulic drive.

18. The cleaning apparatus according to claim 13, wherein the cleaning apparatus further comprises:

a second transmission system that mechanically couples a motor shaft of the motor to the nozzle carriage and that is configured for converting a rotary motion of the motor shaft of the motor into a force pulling the nozzle carriage in at least a first direction along the nozzle carriage path.

19. The cleaning apparatus according to claim 10, wherein the mechanical power take-off member of the hydraulic drive is mechanically coupled to the nozzle carriage for driving the nozzle carriage along the nozzle carriage path.

20. A cleaning system for cleaning a cooling tube array of a heat exchanger, comprising the cleaning apparatus according to claim 10, and wherein the cleaning system further comprises:

a water supply pump positioned separate from the cleaning apparatus, and a tube, wherein the tube connects an output of the water supply pump to the water intake of the cleaning apparatus.

* * * * *